US011116051B1

(12) United States Patent
Shiihara et al.

(10) Patent No.: US 11,116,051 B1
(45) Date of Patent: Sep. 7, 2021

(54) DIMMING POWER SUPPLY DEVICE AND LIGHT SOURCE DEVICE

(71) Applicant: LEIMAC LTD., Moriyama (JP)

(72) Inventors: Takayuki Shiihara, Moriyama (JP); Masamitsu Takemori, Moriyama (JP); Toshihiro Horiuchi, Moriyama (JP)

(73) Assignee: LEIMAC LTD., Moriyama (JP)

( * ) Notice: Subject to any disclaimer, the term of this patent is extended or adjusted under 35 U.S.C. 154(b) by 0 days.

(21) Appl. No.: 17/256,561

(22) PCT Filed: Jul. 8, 2019

(86) PCT No.: PCT/JP2019/026946
§ 371 (c)(1),
(2) Date: Dec. 28, 2020

(87) PCT Pub. No.: WO2020/013110
PCT Pub. Date: Jan. 16, 2020

(30) Foreign Application Priority Data

Jul. 12, 2018 (JP) ..... JP2018-132171

(51) Int. Cl.
*H05B 45/10* (2020.01)
*H05B 45/46* (2020.01)

(52) U.S. Cl.
CPC ..... *H05B 45/10* (2020.01); *H05B 45/46* (2020.01)

(58) Field of Classification Search
CPC ..... H05B 45/10; H05B 45/46
See application file for complete search history.

(56) References Cited

U.S. PATENT DOCUMENTS

2014/0192551 A1* 7/2014 Masaki ..... A61B 1/0661 362/574
2017/0238401 A1* 8/2017 Sadwick ..... H05B 47/195 315/294

FOREIGN PATENT DOCUMENTS

JP 2015-005476 A 1/2015
WO 2014/045647 A1 3/2014

OTHER PUBLICATIONS

International Search Report for International Application No. PCT/JP2019/026946, dated Aug. 20, 2019, 1 pp.
Written Opinion of International Application No. PCT/JP2019/026946, dated Aug. 20, 2019, 3 pp.

* cited by examiner

*Primary Examiner* — Minh D A
(74) *Attorney, Agent, or Firm* — United IP Counselors, LLC

(57) ABSTRACT

A dimming power supply device includes a case, a trigger input connector, a trigger input circuit, an FPGA writing enabling circuit, and a dimming FPGA. The trigger input circuit, the FPGA writing enabling circuit, and the dimming FPGA are disposed inside the case. A plurality of terminals are disposed in the trigger input connector. A signal input to at least one terminal of the plurality of terminals is input to the trigger input circuit. A signal input to the at least one terminal of the plurality of terminals is input to the FPGA writing enabling circuit. In an FPGA writing mode, a circuit configuration of the dimming FPGA is rewritten by inputting an output signal of the FPGA writing enabling circuit. In a dimming mode, a light source is dimmed by inputting an output signal of the trigger input circuit as a trigger.

5 Claims, 4 Drawing Sheets

DIMMING POWER SUPPLY DEVICE AND LIGHT SOURCE DEVICE

CROSS-REFERENCE TO RELATED APPLICATIONS

This application is the U.S. National Phase of International Application No. PCT/JP2019/026946, filed Jul. 8, 2019. This application claims priority to Japanese Patent Application No. 2018-132171, filed Jul. 12, 2018. The contents of those application are incorporated by reference herein in their entireties.

TECHNICAL FIELD

The present invention relates to a dimming power supply device equipped with a dimming field programmable gate array (FPGA) and a light source device equipped with the dimming power supply device.

BACKGROUND ART

A dimming power supply device, which is for dimming LEDs and the like and equipped with a dimming FPGA, is available (see WO 2014/045647, paragraph 0032, FIG. 2). This dimming power supply device can change a circuit configuration by changing a control program stored in a storage unit, hence the control program is designed in accordance with a required dimming mode, and is written in the storage unit during manufacturing.

BRIEF SUMMARY

In some cases, however, rewriting of the control program may be required after manufacturing the dimming power supply device. In order to connect a controller for rewriting the control program to the dimming FPGA, it is necessary to open a cover of a case that covers the dimming power supply device or detach the case itself. This lowers operability when the control program is rewritten.

It is an object of the present invention to provide a dimming power supply device for which a dimming FPGA is easily rewritable, and a light source device equipped with this dimming power supply device.

A dimming power supply device of the present invention includes a case, a trigger input connector, a photocoupler, an FPGA writing enabling circuit, and a dimming FPGA. In the trigger input connector, a plurality of terminals are disposed so as to be exposed to outside from the case. A signal, which is input to at least one terminal of the plurality of terminals, is input to the photocoupler. The FPGA writing enabling circuit is connected to the one terminal connected to the photocoupler. In the dimming FPGA, in an FPGA writing mode, a circuit configuration thereof is rewritten by inputting an output signal of the FPGA writing enabling circuit, and in a dimming mode, a light source is dimmed by inputting an output signal of the photocoupler as a trigger.

The trigger input connector includes a switching terminal that performs switching between the FPGA writing mode and the dimming mode. The FPGA writing enabling circuit includes a tri-state buffer, and the FPGA writing mode is set when a predetermined signal is input from the switching terminal to the tri-state buffer.

A light source device of the present invention includes the dimming power supply device, and a light source which is connected to the dimming length power supply device and is dimmed by the dimming FPGA.

According to the present invention, a dimming power supply device which is capable of rewriting the dimming FPGA safely, and a light source device equipped with the dimming power supply device can be provided.

DETAILED DESCRIPTION

A dimming power supply device and a light source device according to an embodiment of the present invention will be described with reference to the drawings.

Figure 1:
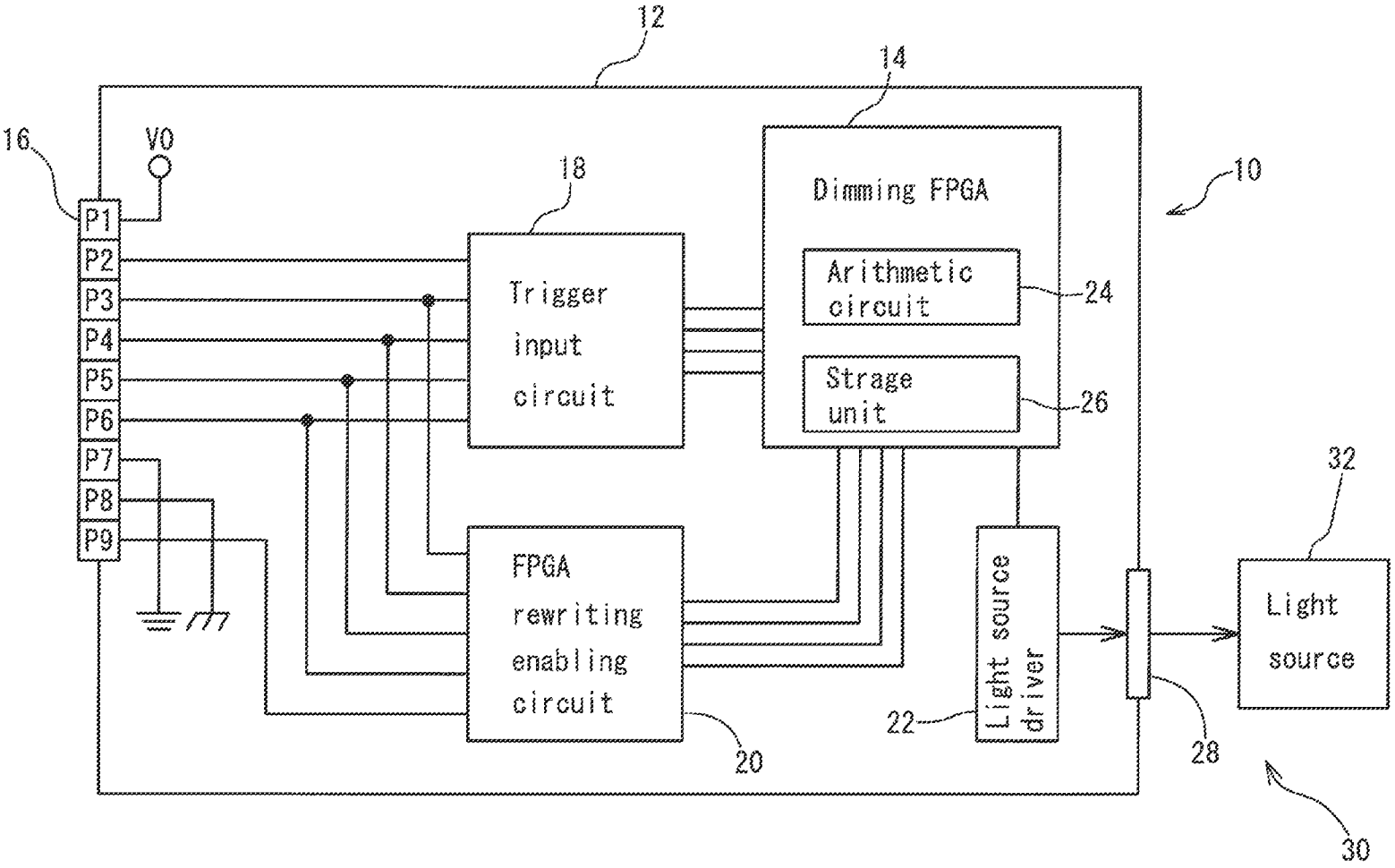
FIG. 1 is a diagram illustrating a configuration of a dimming power supply device of this invention.

A dimming power supply device 10 of this invention illustrated in FIG. 1 includes: a case 12; a dimming FPGA 14; a trigger input connector 16 in which a plurality of terminals P1 to P9 are disposed; a trigger input circuit 18 which is connected between the trigger input connector 16 and the dimming FPGA 14; an FPGA writing enabling circuit 20 which is connected between the trigger input connector 16 and the dimming FPGA 14; and a light source driver 22.

The case 12 is, for example, a box which is rectangular parallelepiped-shaped and houses such electronic circuits and components as the dimming FPGA 14, the trigger input circuit 18, the FPGA writing enabling circuit 20, and the light source driver 22. The case 12 can include buttons to operate the dimming power supply device 10 and a display to display necessary information.

The dimming FPGA 14 includes an operation circuit 24 and a storage unit 26. The storage unit 26 stores a control program. The operation circuit 24 refers to the control program stored in the storage unit 26, and outputs a signal, for adjusting voltage to be applied to a light source 32, to the light source driver 22. The dimming FPGA 14 can change the circuit configuration of the dimming FPGA 14 by changing the control program, so as to change the dimming mode of the light source 32.

The dimming FPGA 14 operates in a dimming mode to dim the light source 32, and in an FPGA writing mode to change the control program. The dimming FPGA 14 is never driven in two operation modes simultaneously, but the dimming FPGA 14 is driven in either one of the operation modes which are switchable.

In the trigger input connector 16, a plurality of terminals P1 to P9 are disposed so as to be exposed from the case 12. The trigger input connector 16 is connected to the trigger input circuit 18 and the FPGA writing enabling circuit 20 in the case 12, and can be connected to two types of devices outside the case 12. One of the two types of devices is a device to input a trigger, and the other is a device to input a signal to rewrite the dimming FPGA 14. These devices can be a device to output a trigger for dimming and a controller to rewrite a control program, which have been used conventionally, and include a computer, a programmable logic controller (PLC), and the like.

The trigger input circuit 18 and the FPGA writing enabling circuit 20 are connected in parallel between the trigger input connector 16 and the dimming FPGA 14. Each input end side of the trigger input circuit 18 and the FPGA writing enabling circuit 20 is connected to certain terminals of the plurality of terminals P1 to P9. In FIG. 1, four terminals, P3 to P6, are connected. The dimming FPGA 14 dims the light source 32 or rewrites the control program in accordance with an output signal, which is outputted from the output end side of either one of the circuits 18 and 20.

In the trigger input connector 16, a switching terminal, which is used to switch the mode of the dimming FPGA 14, is included in the plurality of terminals P1 to P9. This switching terminal is different from the above mentioned terminals P3 to P6. In this embodiment, the terminal P9 is the switching terminal. The input end side of the FPGA writing enabling circuit 20 is connected to the terminal P9. By the signal input to the terminal P9, the start/stop of the FPGA writing enabling circuit 20 are switched. When the FPGA writing enabling circuit 20 is started, the signal is input from the FPGA writing enabling circuit 20 to the dimming FPGA 14, and the dimming FPGA 14 enters the FPGA writing mode. When the dimming FPGA 14 enters the writing mode, a signal from the trigger input circuit 16 is not received or is cancelled even if the signal is received. When a signal is input from the FPGA writing enabling circuit 20 to the dimming FPGA 14, the dimming FPGA 14 is in the dimming mode, and dims the light source 32.

Figure 2:
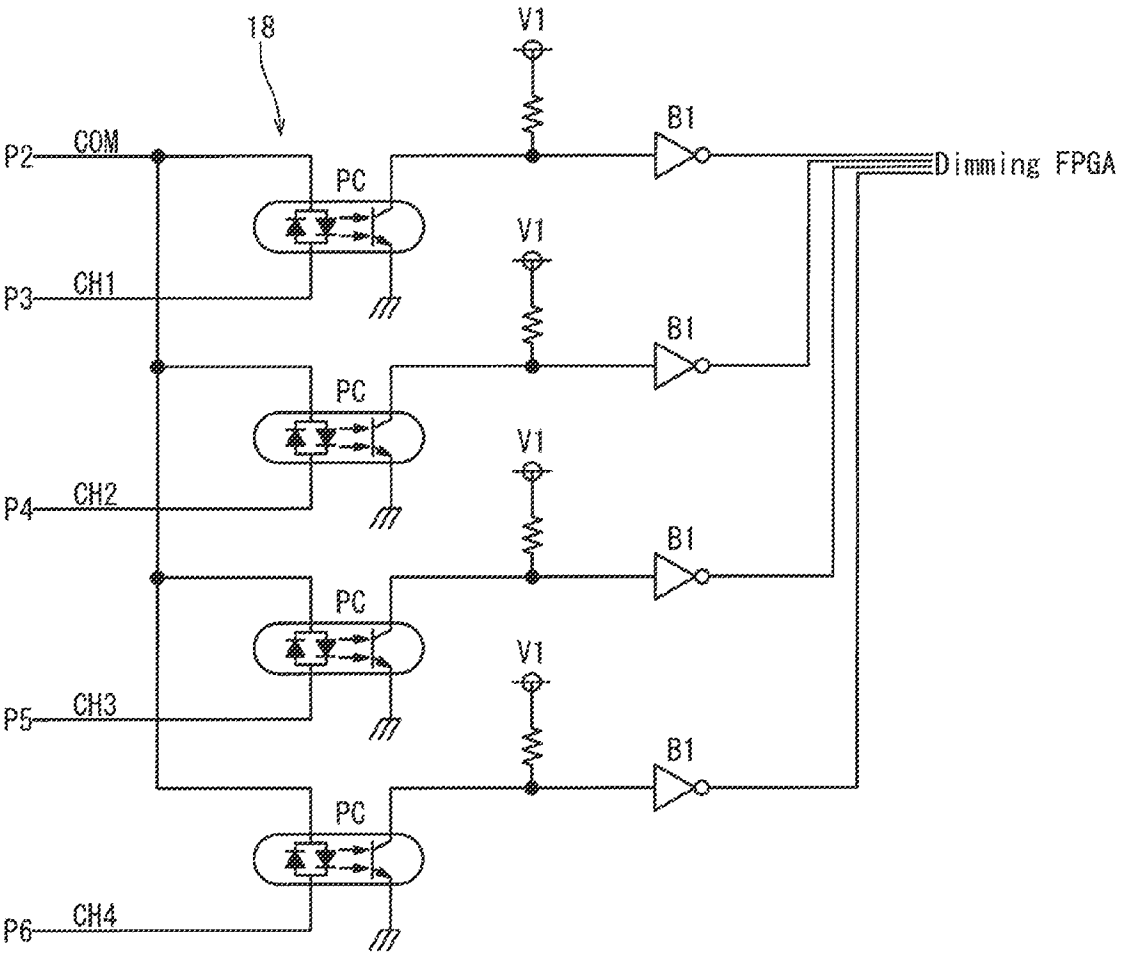
FIG. 2 is a diagram illustrating a configuration of a trigger input circuit of the dimming power supply device of this invention.

When a trigger is input to each terminal P3 to P6, the trigger input circuit 16 drives the dimming FPGA 14 by inputting the trigger to the dimming FPGA 14 at a predetermined voltage. In the case of inputting a trigger using four channels, the trigger input circuit 18 uses four identical circuits, as illustrated in FIG. 2. Each circuit includes a photocoupler PC and a buffer B1. The photocoupler PC of each circuit is connected to the terminal P2, i.e., common terminal, and is also connected to one of the terminals P3 to 6. In the photocoupler PC in FIG. 2, two light-emitting diodes are connected in reverse-parallel, but a photocoupler using one light-emitting diode can be used.

In the trigger input circuit 18 in FIG. 2, when a trigger is input, the photocoupler PC turns on, and the potential which is input to the buffer B1 becomes ground level. Here a pulse having a predetermined potential is used as a trigger. When a trigger is not input, the potential which is input to the buffer B1 becomes a potential from the power supply V1. By this change in potential, the output of the buffer B1 changes, and the trigger is input to the dimming FPGA 14. In this embodiment, the dimming FPGA 14 changes the dimming method of the light source 32 by inputting each trigger using the four channels.

The trigger input circuit 18 is insulated using the photocoupler(s) PC, so as to prevent a malfunction caused by the difference in ground levels between the trigger input circuit 18 and the other circuits. Further, using the buffers B1 prevents the upstream side and the downstream side of the buffers B1 from interfering with each other. In FIG. 2, four buffers B1 are used, but can be integrated into one or two ICs.

Figure 3:
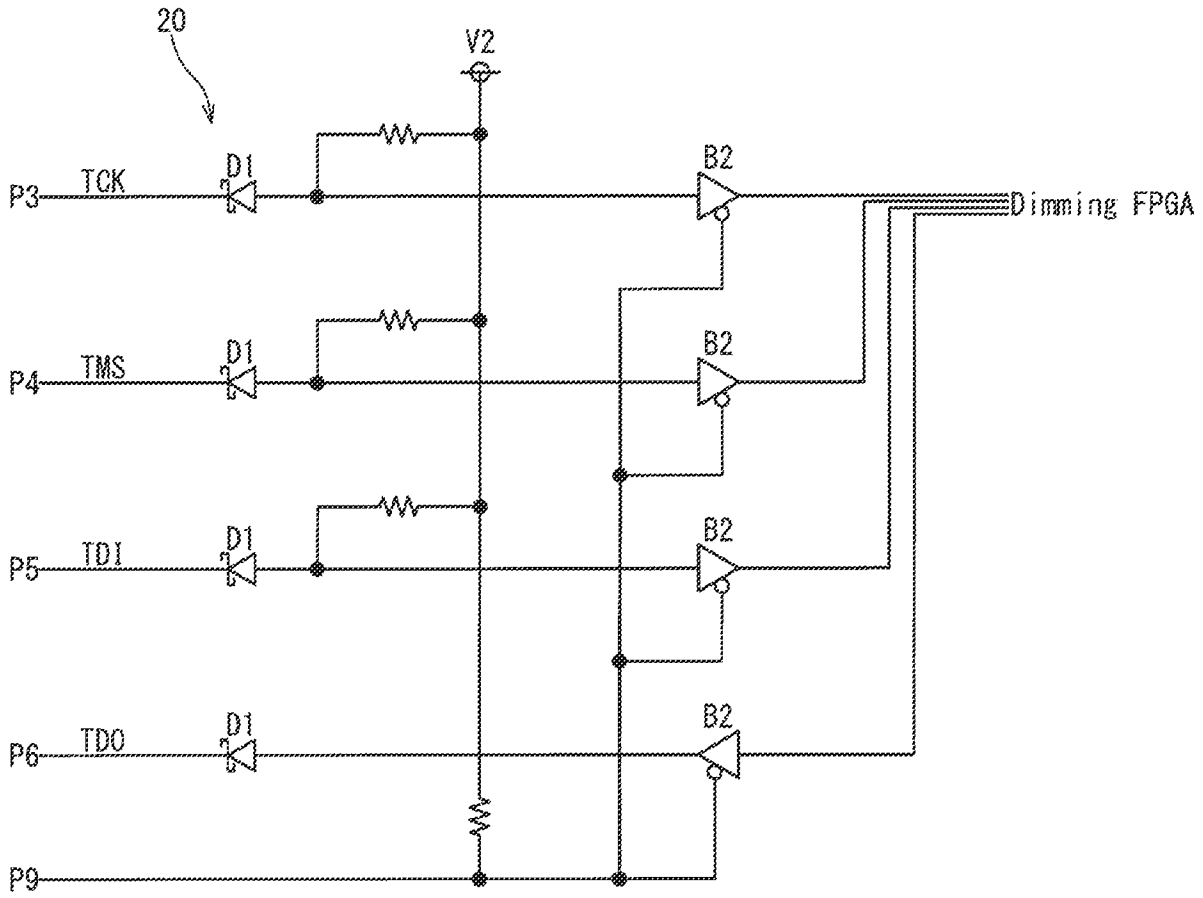
FIG. 3 is a diagram illustrating a configuration of an FPGA rewriting enabling circuit of the dimming power supply device of this invention.

The FPGA writing enabling circuit 20 connects a device, which is disposed outside the case 12 and used for rewriting the control program, to the dimming FPGA 14. Therefore the FPGA writing enabling circuit 20 is an interface conforming to the Joint Test Action Group (JTAG) standard. As illustrated in FIG. 3, the terminal P3 is a terminal for a test clock (TCK) signal, the terminal P4 is a terminal for a test mode select (TMS) signal, the terminal P5 is a terminal for a test data in (TDI) signal, and terminal P6 is a terminal for a test data out (TDO) signal, and the input end side of the FPGA writing enabling circuit 20 is connected to these terminals.

A series circuit of a diode (including a Schottky barrier diode) D1 and a tri-state buffer B2 is connected to each terminal P3 to P6. A cathode of the diode D1 is connected to each terminal P3 to P6, and an anode thereof is connected to the tri-state buffer B2. When a signal is input to each terminal P3 to P5, the potential to be input to the tri-state buffer B2 changes in accordance with the potential level of the signal. In this embodiment, if the potential to be input to each terminal P3 to P5 is a 0 to positive potential, the potential to be input to the tri-state buffer B2 is 0 or is the potential from the power supply V2. In accordance with this potential change, the output of the tri-state buffer B2 changes, whereby the signal to rewrite the control program can be input to the dimming FPGA 14. The terminal P6 is a terminal for a TDO signal, hence the direction of input/output is the opposite from the other tri-state buffers B2, and the potential of the power supply V2 is not input between the diode D1 and the tri-state buffer B2. The four tri-state buffers B2 in the FPGA writing enabling circuit 20 in FIG. 3 can be integrated into one IC.

The terminal P9 and the power supply V2 are connected to the tri-state buffer B2. While the potential of the power supply V2 is input to the tri-state buffer B2, the tri-state buffer B2 is off. In this state, the FPGA writing enabling circuit 20 does not operate, and the control program cannot be rewritten. When a predetermined signal (a grand level signal in this embodiment) is input from the terminal P9 to the tri-state buffer B2, the tri-state buffer B2 turns on, and the FPGA writing enabling circuit 20 is driven. When the signal is input from the FPGA writing enabling circuit 20 to the dimming FPGA 14, the dimming FPGA 14 enters the rewriting mode. This means that this terminal P9 functions as the terminal for switching the mode.

The terminals P1 to P9 of the trigger input connector 16 are for connecting a device for inputting a trigger. Therefore if a device for rewriting the control program cannot be directly connected to the terminals P1 to P9 of the trigger input connector 16, the device is connected via an adaptor circuit. In this case, a level shifter, which can convert the voltage level into a level of voltage that can be input to the trigger input connector 16, is included in the adaptor circuit. Thereby different devices can be connected to one of terminals P1 to P9, so that a number of terminals need not be increased to connect different devices.

Table 1 shows connection of each terminal P1 to P9 of the trigger input connector 16. As mentioned above, both the trigger input circuit 16 and the FPGA writing enabling circuit 20 are connected to each terminal P3 to P6. The dimming mode and the FPGA writing mode are switched depending on whether the terminal P9 is at ground level or not. To the terminal P1, the voltage of the power supply V0 is input, and the terminals P7 and P8 are connected to the power supply V0 or to the ground level inside the case. The terminal P2 is used as a common terminal COM of each channel CH1 to CH4 in the dimming mode. When a trigger is input, the terminal P9 is in the unconnected state, and when the control program is rewritten, the terminal P2 is in the unconnected state.

TABLE 1

| Terminal | Trigger input | FPGA rewriting |
|---|---|---|
| P1 | Power supply voltage | |
| P2 | COM | Unconnected |
| P3 | CH1 | TCK |
| P4 | CH2 | TMS |

TABLE 1-continued

| Terminal | Trigger input | FPGA rewriting |
|---|---|---|
| P5 | CH3 | TDI |
| P6 | CH4 | TDO |
| P7 | Power supply GND | |
| P8 | Internal GND | |
| P9 | Unconnected | GND |

The light source driver 22 applies a predetermined voltage to the light source 32 in accordance with the output of the dimming FPGA 14. A terminal 28 is disposed between the light source driver 22 and the light source 32 to connect the light source driver 22 and the light source 32.

Figure 4:
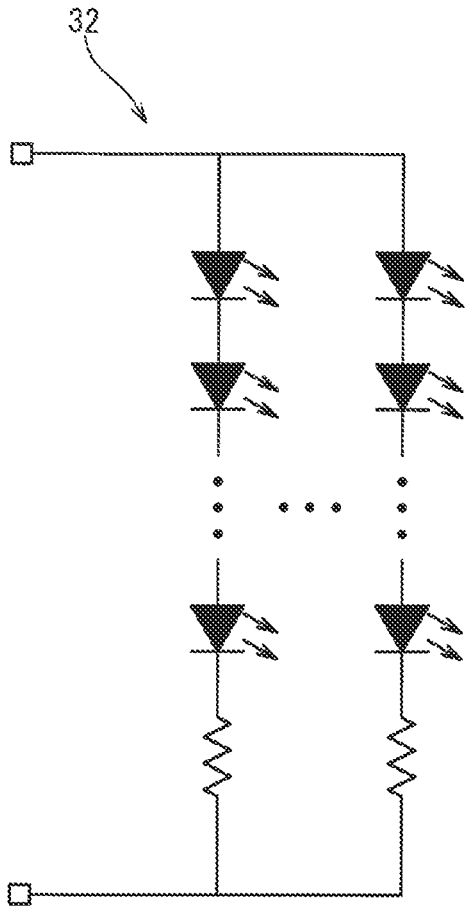
FIG. 4 is a diagram illustrating a configuration of a light source.

In a light source device 30 of the present invention, the light source 32 is connected to the light source driver 22 of the dimming power supply device 10, and the light source 32 is dimmed by the dimming power supply device 10. As illustrated in FIG. 4, the light source 32 can be constituted of a circuit in which a plurality of light-emitting diodes are arranged in a series-parallel connection.

Next, an operation of the dimming power supply device 10 of this embodiment will be described. In the case where a device to input a trigger is connected to the trigger input connector 16, a trigger is input to each terminal P3 to P6. Then the trigger is input from the trigger input circuit 18 to the dimming FPGA 14, and the light source 32 is dimmed by the dimming FPGA 14. When a device to rewrite the control program is connected to the trigger input connector 16, the terminal P9 becomes the ground level, and the tri-state buffer B2 of the FPGA rewriting enabling circuit 20 starts up. By inputting a signal to rewrite the control program to each terminal P3 to P5 in the state where the tri-state buffer B2 is active, the signal is outputted to the dimming FPGA 14, and the FPGA rewriting mode is set. The control program of the dimming FPGA 14 is rewritten by the signal for rewriting.

As described above, the dimming power supply device 10 of the present invention can rewrite the control program of the dimming FPGA 14 without opening the case 12, hence operability when the control program is rewritten is good. The terminals P1 to P9 are exposed from the case 12, and the circuit configuration of the dimming FPGA 14 is less likely to be changed in error, unless a signal to startup the FPGA rewriting enabling circuit 20 is input. The terminals P3 to P6, which are conventionally used for inputting a trigger, are also used for rewriting the control program, hence the device configuration does not become too complicated.

The present invention is not limited to the above embodiment. For example, the triggers are input via four channels, but can be input via eight channels or sixteen channels. In this case, a number of terminals of the trigger input connector 16 is changed in accordance with the number of channels.

The signal level to be input to each terminal P3 to P6 can be changed depending on the circuit configuration of the FPGA rewriting enabling circuit 20. For example, besides signals in the range of 0 to positive voltage, signals in the range of negative voltage to 0, or negative voltage to positive voltage can be input to the terminals P3 to P6.

While the dimming power supply device and the light source device according to the embodiment of the present invention have been described, the present invention can be improved, corrected or modified in various ways based on the knowledge of an expert in the art within a range that does not depart from the essence thereof.

REFERENCE SIGNS LIST

10 Dimming power supply device
12 Case
14 Dimming FPGA
16 Trigger input connector
18 Trigger input circuit
20 FPGA rewriting enabling circuit
22 Light source driver
24 Operation circuit
26 Storage unit
28 Terminal
30 Light source device
32 Light source
P1 to P9 Terminal
V0, V1, V2 Power supply
PC Photocoupler
B1, B2 Buffer
D1 Diode

The invention claimed is:

1. A dimming power supply device, comprising:

a case;

a trigger input connector in which a plurality of terminals are disposed to be exposed to outside from inside of the case;

a trigger input circuit disposed inside the case, a signal input to at least one terminal of the plurality of terminals being input to the trigger input circuit;

an FPGA writing enabling circuit disposed inside the case, a signal input to the at least one terminal of the plurality of terminals being input to the FPGA writing enabling circuit; and a dimming FPGA disposed inside the case, in an FPGA writing mode, a circuit configuration thereof being rewritten by inputting an output signal of the FPGA writing enabling circuit, and in a dimming mode, a light source being dimmed by inputting an output signal of the trigger input circuit as a trigger.

2. The dimming power supply device according to claim 1, wherein the trigger input circuit includes a photocoupler to which the signal input to the at least one terminal is input.

3. The dimming power supply device according to claim 1, wherein the trigger input connector includes a switching terminal configured to perform switching between the FPGA writing mode and the dimming mode.

4. The dimming power supply device according to claim 3, wherein the FPGA writing enabling circuit includes a tri-state buffer, and the FPGA writing mode is set when a predetermined signal is input from the switching terminal to the tri-state buffer.

5. A light source device, comprising:

the dimming power supply device according to claim 1; and a light source connected to the dimming power supply device and configured to be dimmed by the dimming FPGA.

* * * * *